US005382113A

United States Patent [19]

Chilton et al.

[11] Patent Number: 5,382,113

[45] Date of Patent: Jan. 17, 1995

[54] MANHOLE AQUA BLOK INFLOW PROTECTOR

[76] Inventors: Jack Chilton, 17288 Earth Wind, Dallas, Tex. 75248; C. Richard Braswell, 13829 Creekside Pl., Dallas, Tex. 75240

[21] Appl. No.: 119,308

[22] Filed: Sep. 13, 1993

[51] Int. Cl.[6] ..... E02D 29/12

[52] U.S. Cl. ..... 404/25; 52/20

[58] Field of Search ..... 404/25, 26; 52/19, 20

[56] References Cited

U.S. PATENT DOCUMENTS

| | | | |
|---|---|---|---|
| 3,308,727 | 3/1967 | Hurt | 404/25 X |
| 4,097,171 | 6/1978 | Fier | 404/26 |
| 4,469,467 | 9/1984 | Odill et al. | 405/25 |
| 4,650,365 | 3/1987 | Runnels | 404/25 |
| 4,867,601 | 9/1989 | Bowman | 404/26 |
| 4,957,389 | 9/1990 | Neathery | 404/72 |
| 5,232,120 | 8/1993 | Dunken et al. | 220/661 |
| 5,299,884 | 4/1994 | Westhoff et al. | 404/25 |

*Primary Examiner*—Ramon S. Britts

*Assistant Examiner*—James A. Lisehura

*Attorney, Agent, or Firm*—John L. Palmer

[57] ABSTRACT

An Aqua-Blok that fits into a frame or cone of a manhole directly beneath the cover, in the frame below the cover or within the cone to catch water that seeps into the manhole. Aqua-Blok is a polyurea, flexible bowl that rests on the frame directly under the cover or is mounted in frame or the cone. When used in the lower frame, it has a closed cell gasket on its outer top side, and an adjustable stainless steel ring on its inner circumference to press it against the frame. When Aqua-Blok is placed in the cone, it uses a rubber mount placed within the cone to mount Aqua-Blok. The rubber mount has a core with concentric rubber rings on its outer periphery that match the sloped sides of the cone. It has a circular cavity in its inner circumference to receive the pressure ring. The pressure ring forces the core and the concentric rings against the wall of the cone in a watertight fit. The bowl is seated on the mount where it catches any water that flows into the manhole from above it.

8 Claims, 4 Drawing Sheets

MANHOLE AQUA BLOK INFLOW PROTECTOR

This invention relates to a water tight insert for a manhole to prevent water from flowing through the manhole into a sanitary system.

DESCRIPTION OF THE PRIOR ART

In urban areas where rain or other surface water is to be carried away by concrete conduits of various kinds, water often covers manholes for extended periods of time. If the manholes leak, the water drains into a sanitary system to which the manholes connect. In many cases the water will overload the sanitary system.

A typical manhole has a circular frame, generally made of cast iron, which is mounted on a chimney or cone section in the manhole. A cover, or lid, is placed over the manhole in contact with the frame and flush with an overhead roadway surface. Generally, an inflow protector is placed under the cover to stop water from seeping under or around the cover.

Water leaks come from many places within the manhole. For example from the frame, chimney, or cone. Because the chimney and cone are made of concrete or brick. The inner walls may crack after a time and allow ground water to flow through the cracks into the sanitary system. Also, any seal between the frame and cone can crack, allowing water to seep down the sides of the cone into the sanitary system. These cracks occur for many reasons: heavy auto traffic, temperature changes and shifting of the ground in the area of the manhole.

Numerous patents have issued for devices in manholes to capture or block water that may flow into the manhole from the various water seepage spaces.

U.S. Pat. No. 4,650,365 discloses a bowl shaped insert that mounts within the frame, directly under and in contact with the frame and manhole cover. The insert collects water that leaks in from around the cover. Auto traffic over the cover can deform or break the interface between the bowl and cover. The break can cause the bowl to become weak or crack and break, allowing water to flow under the outer edges of the bowl and into the manhole. The bowl can become so weakened that it will break and fall into the manhole.

U.S. Pat. No. 4,469,467 discloses a circular, rubber gasket that is placed on the inner side walls of the frame and chimney of the manhole. It uses pressure rings to press the gasket against the side walls of the chimney to stop water from seeping through the sides of the frame or chimney into the sanitary system.

U.S. Pat. No. 4,957,389 discloses a retaining support placed in the cone of the manhole. The edges of the support are sealed by cement, and a bowl is seated on the cement to collect water that seeps into the manhole from the top, frame, or upper cone.

Manholes found throughout many cities vary in shape. They may be concentric, eccentric, offset, or other shapes. It thus becomes advantageous to have a water seal insert that is inexpensive, easy to install and remove, and when located within the manhole catches any water that flows into the manhole from above it. It is also advantageous to have an insert that is made of a noncorrosive material, because the manholes may have hydrogen sulfide gas, other gases and sulfuric acid that are normally found in a manhole.

SUMMARY OF THE INVENTION

We have invented a manhole water seal insert we refer to herein as AquaBlok. AquaBlok is a flexible bowl made of polyurea material with a diameter that will match the diameter of a frame or cone of a manhole wherein it is to be placed. It has an upper inner bowl surface and outer edge bowl or flange. AquaBlok may be sized to be inserted into the frame or the come of the manhole or both simultaneously. AquaBlok can be easily placed in, or removed from, a manhole to catch water that may leak into the manhole from its cover, frame, chimney or cone. When placed within the frame, AquaBlok can be placed directly under the cover, or lower within the frame. When placed under the cover, it rests on the frame directly under the cover. When placed lower within the frame we compress it against the sides of the frame by using a compressible, closed-cell gasket on the top outer bowl surface, and an adjustable, stainless steel pressure ring within the upper, inner surface. The pressure ring can be adjusted for diameter size, and has a snap-lock handle that expands the pressure ring to force it against the upper inner surface of the bowl. The gasket is thus securely pressed against the inner sides of the wall surface of the frame.

When we use AquaBlok in the cone of the manhole the flexible bowl has a flange on its upper edge, and we provide a rubber mount on which the flange rests. The mount is secured against the inner side of the upper cone. The mount is made of a hard rubber core with concentric rings on its outer surface that are tapered to match sloped walls of the cone. The steel pressure ring is placed within the inner circumference of the core to press the core and rings against the wall of the cone. The flexible bowl is placed on the top of the mount and catches any water that flows into the manhole from above its location.

Therefore, an objective of our invention is to provide an Aqua-Blok for a manhole that can be placed within and easily removed from the frame or cone of the manhole to block water that may flow into the manhole through its cover, frame, or cone into a connected sanitary system.

Another objective is to provide an Aqua-Blok that is easily placed within or removed from the frame or cone of the manhole and will not be affected by traffic over the manhole, temperature changes, or shifts in the surrounding ground.

A feature of our invention is that it is flexible and can be inserted into a manhole that has a frame entrance much smaller in diameter than the position within the manhole that the Aqua-Blok is to be installed.

Another feature of our invention is that the Aqua-Blok is made of polyurea material, formed by spraying the polyurea onto a form and curing it for a short time.

DETAILED DESCRIPTION OF THE DRAWINGS

Figure 1:
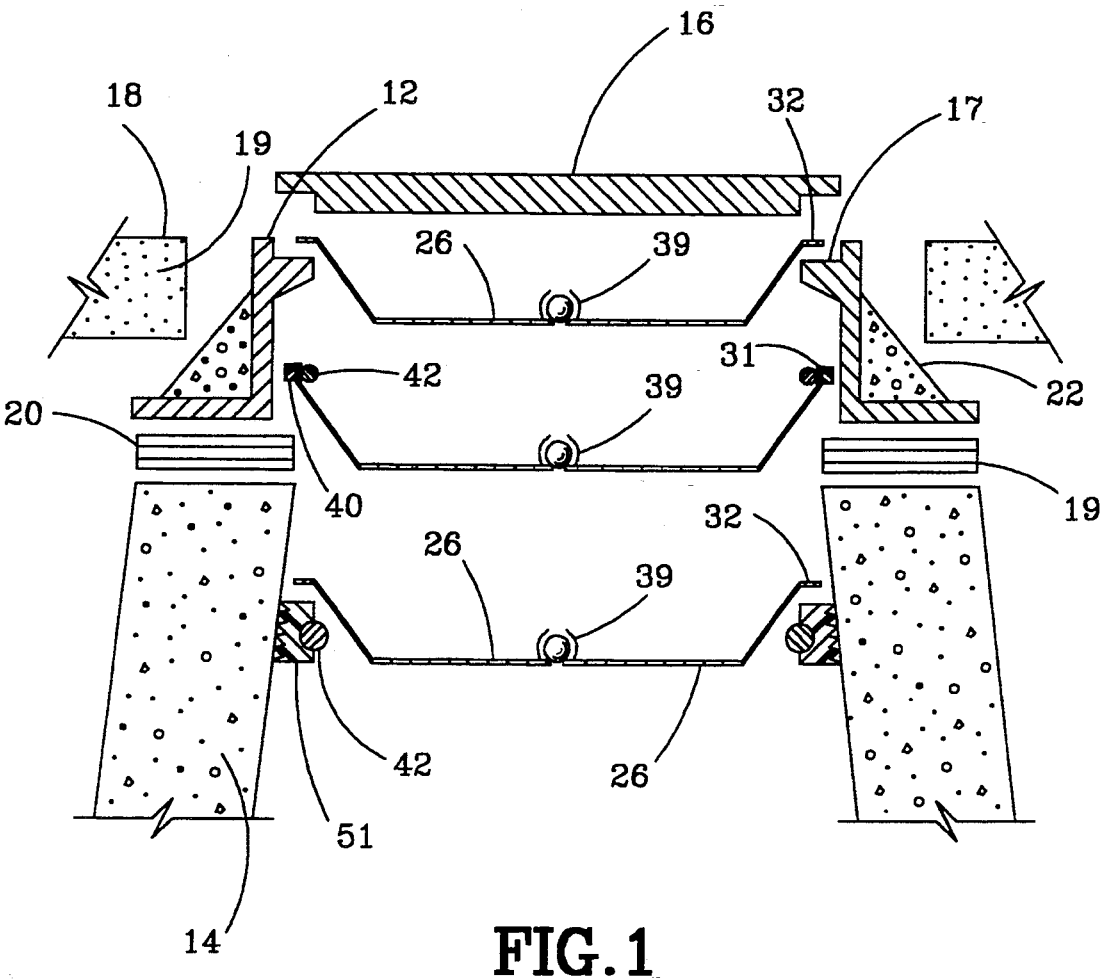
FIG. 1 is an exploded sectioned view of a typical manhole with cross sections of Aqua-Blok positioned within the manhole.

We refer you first to FIG. 1, where we show an exploded cross section view of a typical manhole. The manhole includes a frame 12, which is generally made of cast iron, and a cone 14, generally made of concrete, brick block, or the like. A metal cover 16 usually covers the frame 12, and is level with a street surface 18. The cover 16 rests on lateral protrusions 17 of the frame 12. The frame 12 may be mounted and sealed onto the cone 14 or a chimney 19. The frame 12 is sealed at joint 20 by any one of a number of techniques to bind metal to concrete. Support material 22 may be affixed around the outer side of the frame 12. The frame 12 provides an opening from the street surface 18 into the inner portions of the manhole.

We show in FIG. 1, for simplicity of description, a concentric cone manhole. One using our invention would understand that the cone 14 can, however, be eccentric, offset, or other shapes. In FIG. 1, we show Aqua-Blok placed in three positions within the manhole. The first position is under the cover 16 to rest on the protrusions 17; the second is to be attached to the wall of the frame 12, and third to rest on a mount on the wall of the upper part of the cone 14. Aqua-Blok can be placed in any of these positions simultaneously, but generally would be placed in only one position.

Figure 2:
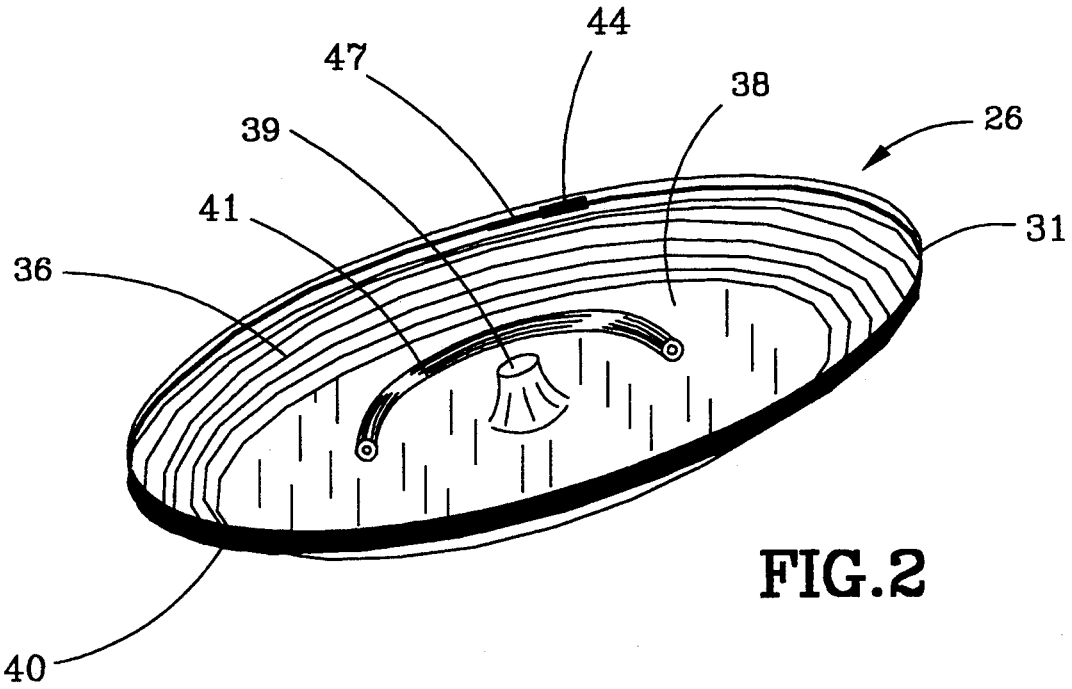
FIG. 2 is a perspective view of an embodiment of Aqua-Blok for use in a manhole frame.
Figure 3:
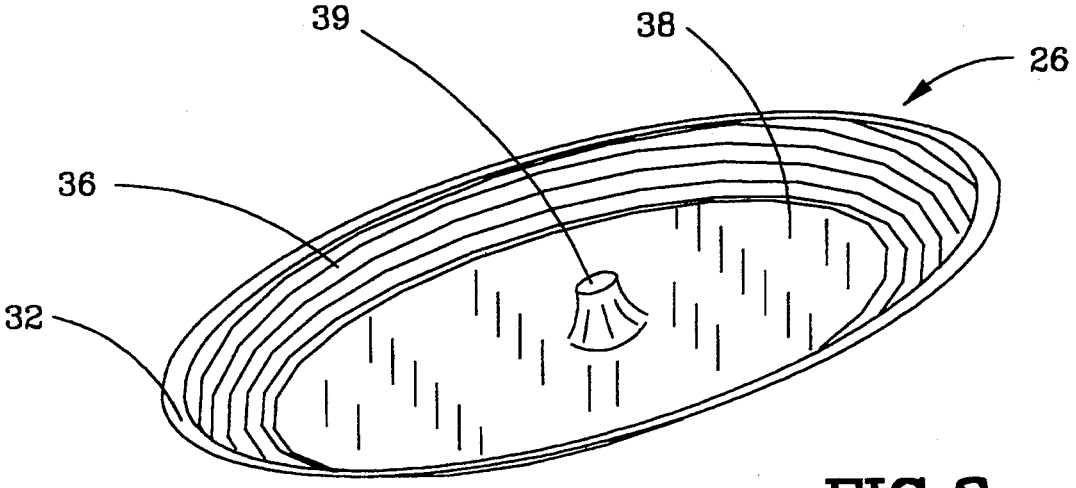
FIG. 3 is a perspective view of an embodiment of Aqua-Blok for use in a manhole cone or directly under the manhole cover.

Refer now to FIGS. 2 and 3. Here we show two perspective views of Aqua-Blok. It is a bowl 26 formed of polyurea material, that is formed by spraying polyurea material onto a form in a shape desired for Aqua-Blok use. Aqua-Blok, as shown in FIGS. 2 and 3, is circular shape but can take other shapes. For example, it can be elliptical. It has a diameter that approximates the diameter of the frame 12 or the cone 14, depending upon where Aqua-Blok is to be placed.

Figure 4:
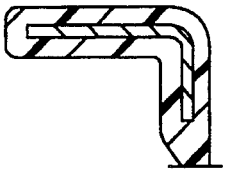
FIG. 4 is a sectioned view of a portion of the embodiment of FIG. 3 showing an encapsulated steel frame on its' outer rim.

Aqua-Blok may have an upstanding upper rim 31 as shown in FIG. 2 or a flanged upper edge 32, as shown in FIG. 3. The shape of the rim and flange depend upon where Aqua-Blok is to be placed. As shown in FIG. 1, Aqua-Blok may be placed in the frame 12, cone 14, or directly under the metal cover 16 on the protrusions 17. For support we may include a stainless steel angle bracket in the flange 32, as shown in FIG. 4 when Aqua-Blok is to be placed directly under the cover 16 on the protrusions 17. The bowl 26 has sloped inner sides 36, which slope toward a bottom 38 where a gas relief valve 39 is located. The relief valve 39, as shown, is a ball valve that is held in a closed position by gravity. The ball valve 39 will be forced upward by gas in the manhole. It will be open for only a short period of time to let trapped gas escape but will not be open long enough to allow significant amounts of water to flow into the manhole. The ball valve 39 is one of many gas relief valves that may be used with this invention. Any number of gas relief valves, including holes in the top of the bowl 26, can be used with our invention without detracting from the scope of the invention.

The polyurea material, of which the bowl 26 is made, cures rapidly to form a bowl 26 that is strong and flexible. Flexibility is important because a polyurea bowl can be bent to pass through the frame 12 into the manhole and be positioned within a cone 14 that may be considerably larger in diameter than the frame 12. A metal bowl that is to be positioned into the cone 14 cannot be passed through the frame 12 because of its larger diameter. Strength of the bowl 26 is important because of the weight of water that it has to hold.

When Aqua-Blok is placed within the frame 12 of the manhole, below the protrusions 17, we provide a gasket 40, as shown in FIGS. 1 and 2 made of closed-cell material, such as neoprene, which is attached to the upper, outer rim 31 of the bowl 26. We put a sealant (not shown) on the inner surface of the gasket 40 for a water tight contact with the bowl 26. For ease of removal of Aqua-Blok from the manhole we provide a strap 41 that can be attached to the bowl 26 at various positions.

Figure 7:
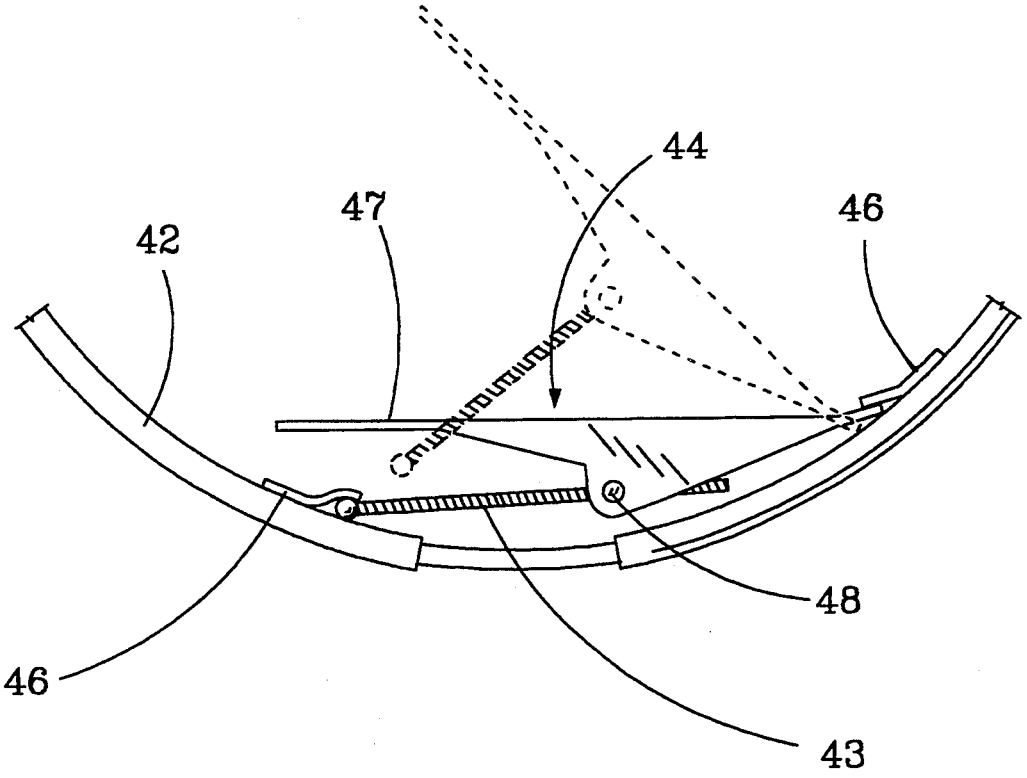
FIG. 7 is a perspective view of a latch for the pressure ring.

We press Aqua-Blok against the frame 12 to hold a heavy water load by using a stainless steel pressure ring 42, shown in FIG. 7. The pressure ring 42 is placed within the top inner circumference of the bowl 26 on the rim 31, as shown in FIGS. 1 and 2. The pressure ring 42 consists of a steel band with an adjustable bolt 43 that connects the pressure ring 42 into a circle. The pressure ring 42 also includes a latch 44. The pressure ring 42 is made of stainless steel and can be round or flat depending upon the position in which it is to be placed. For example, when used with the embodiment of FIG. 1 it may round and approximately $\frac{3}{8}$ inch O.D. When used with the embodiment of FIG. 3 it may be a steel band $\frac{1}{2}$ inch wide and 3/16 inch thick, just to use a few examples. The adjustable bolt 43 permits use of the pressure ring 42 with many sizes of the bowl 26.

The latch 44, further shown in FIG. 8, is mounted between two stays 46, which are preferably tubing, welded on the inner circumference of the pressure ring 42. The latch 44 includes a handle 47, that is movable between open and closed positions, around a rivet 48. When the handle 47 is moved to the closed position the pressure ring 42 is expanded outwardly against the upper, inner surface of the bowl 26. The gasket 40 located on the outer, upper surface of the bowl 26 is thus compressed against the wall of the frame 12. The sealant placed on the inner surface of the gasket 40 insures a secure seal between the bowl 26 and the frame 12.

Figure 6:
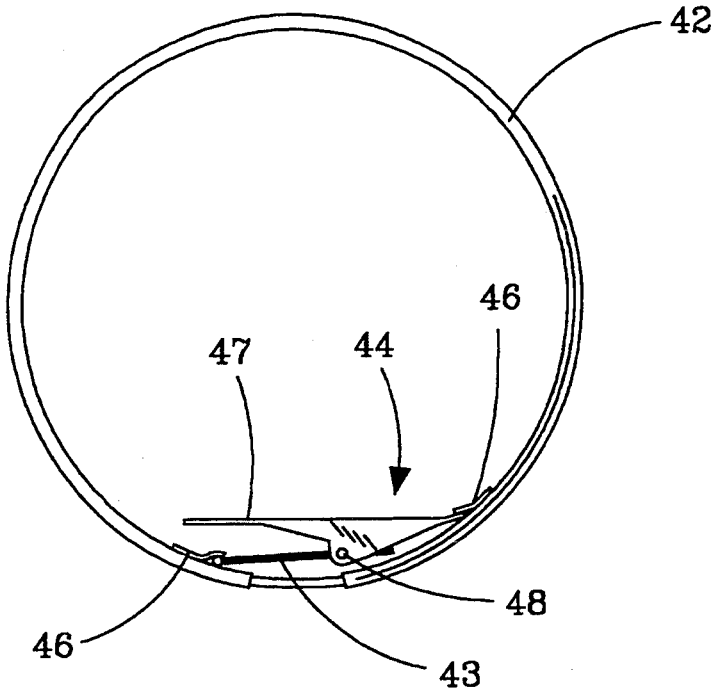
FIG. 6 is a view of a pressure ring for Aqua-Blok.

When Aqua-Blok is installed in the cone 14, we use a rubber mount 50, shown in FIG. 6, which we prefer to be made of EPDM rubber to mount Aqua-Blok within the cone 14. The mount 50 has a hard rubber core 51 and concentric rubber rings 54 on its outer periphery that are shaped to mate the slope of the sides of the cone 14. It has a concentric cavity 56 within its inner periphery to accept the pressure ring 42. When the latch 44 is closed, in this use, the core 51 is pressed against the wall of the cone 14, producing a watertight seal between the concentric rings 54 and the wall of the cone 14. The bowl 26 is then placed on the mount 50. As shown in FIG. 1, the bowl 26 of FIG. 3 can also be placed under the cover 16 on the protrusions 17.

The bowl 26 will can be inserted into any size manhole without regard to the diameter of the frame by bending it inwardly toward its center, and positioning it into place wherein it straightens into its bowl shape in the position within the diameter of the manhole where it is to catch the water.

Figure 5:
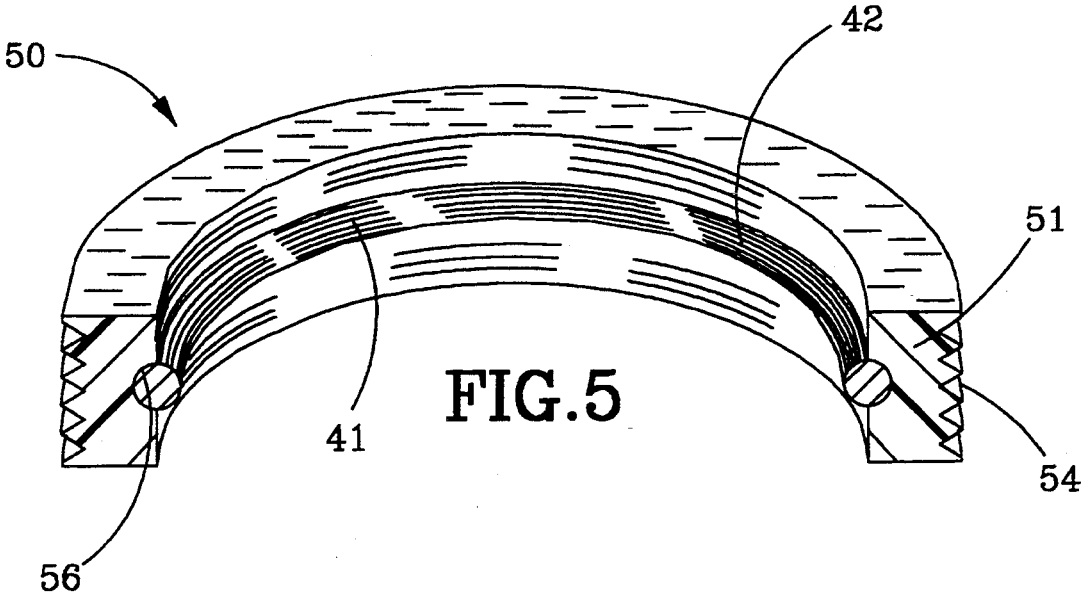
FIG. 5 is a sectioned view of a rubber mount for the cone section of a manhole when the embodiment of FIG. 3 is used.

When Aqua-Blok is used in the frame 12, below the protrusions 17, the pressure ring 42 may be placed into position after Aqua-Blok is within the manhole. When used in the frame 12 and placed on the protrusions 17, no adjustment rod 23 or steel pressure ring 42 would be required. However, it may be advisable to add the stainless steel angle brace shown in FIG. 5 into the edge of the flange 32 for support. This addition is optional. When the bowl 26 is used in the frame 12, below the protrusions 17, the adjustment rod 23 will have been previously adjusted so that the latch 44 will force the pressure ring 42 against the inner edge of the bowl 26. The gasket 40 is thus pressed against the wall surface of the frame 12.

While the preferred embodiments of our invention have been described above, it will be recognized that variations may be made therein, and the appended claims are intended to cover such variations.

We claim:

1. For a manhole of prescribed circular radial dimensions that has a cover over an opening into a circular frame mounted on a chimney and or cone, an improved water block insert for the manhole, comprising:

a flexible bowl, having an inner, upper surface and outer, upper rim on the bowl with dimensions shaped to match the circular radial dimensions of the frame;

a compressible gasket secured on the outer, upper rim of the bowl;

an expandable, steel ring mounted within the inner, upper surface of the bowl, and latch means on said ring, for expanding and latching said ring against the inner edge of the bowl, thus forcing the rim of the bowl and the gasket against the frame of the manhole to secure said bowl in a position to catch any water that seeps into the manhole above the water block insert.

2. Apparatus as claimed in claim 1 in which said bowl is formed of polyurea material.

3. Apparatus as claimed in claim 1 in which said gasket is composed of closed-cell material and has an adhesive on its inner surface.

4. Apparatus as claimed in claim 1 in which said forcing means is a latch having a lock handle attachable to said steel ring for forcing the ring outward radially when said lock handle is closed.

5. For a manhole that has a cover over the top and an opening into a circular frame mounted on a chimney or cone having an inner side wall, an improved water block insert for the manhole, comprising:

a circular rubber mount, open in its center inserted into the manhole to the cone and being shaped to be compressed against the inner side of the cone;

an expandable, steel ring positioned within the circular rubber mount and being expandable outwardly to compress the mount against the inner side of the cone;

means for expanding said ring outward and for locking said ring in the expanded position, and a flexible polyurea bowl, of diameter approximate to the diameter of the cone, seated on the mount to catch any water that flows into the manhole from above the mounted position of the bowl.

6. Apparatus as claimed in claim 5 in which said mount comprises a plurality of concentric rubber rings on its outer periphery, and a recessed cavity within its inner circumference to accept said expandable ring for compressing and locking said mount against the wall of the cone.

7. Apparatus as claimed in claim 6 in which said expandable ring includes a latch that is movable from an open position to a latching position in which said ring is forced outward radially.

8. Apparatus as claimed in claim 5 in which said bowl has a flanged upper surface and a stainless steel support within said flange.

* * * * *